US009737744B2

(12) United States Patent
Austin

(10) Patent No.: US 9,737,744 B2
(45) Date of Patent: Aug. 22, 2017

(54) TOWEL STRETCHING ASSEMBLY FOR STRETCHING EXERCISES

(71) Applicant: John David Claude Austin, Vancouver (CA)

(72) Inventor: John David Claude Austin, Vancouver (CA)

( * ) Notice: Subject to any disclaimer, the term of this patent is extended or adjusted under 35 U.S.C. 154(b) by 35 days.

(21) Appl. No.: 14/576,058

(22) Filed: Dec. 18, 2014

(65) Prior Publication Data

US 2016/0175636 A1 Jun. 23, 2016

(51) Int. Cl.
*A63B 21/002* (2006.01)
*A63B 21/02* (2006.01)
(Continued)

(52) U.S. Cl.
CPC ..... *A63B 21/0023* (2013.01); *A61H 1/0237* (2013.01); *A61H 1/0274* (2013.01);
(Continued)

(58) Field of Classification Search
CPC ..... A61H 1/02; A61H 1/0237; A61H 1/0266; A61H 1/0274; A61H 1/0285; A61H 1/0288; A61H 2001/027; A63B 26/00; A63B 23/00; A63B 23/035; A63B 23/03516; A63B 23/0355; A63B 23/03575; A63B 23/04; A63B 23/10; A63B 23/12; A63B 23/16; A63B 21/00; A63B 21/0004; A63B 21/00043; A63B 21/00178; A63B 21/00185; A63B 21/002; A63B 21/0023; A63B 21/02; A63B 21/021; A63B 21/022; A63B 21/023; A63B 21/025; A63B 21/026; A63B 21/027; A63B 21/028; A63B 21/04; A63B 21/0407; A63B 21/0414;
(Continued)

(56) References Cited

U.S. PATENT DOCUMENTS

| | | | |
|---|---|---|---|
| 4,428,577 | A | 1/1984 | Weingardt |
| 5,498,218 | A | 3/1996 | Proctor et al. |

(Continued)

FOREIGN PATENT DOCUMENTS

| | | |
|---|---|---|
| DE | 102004056220 | 6/2005 |
| JP | 2009-172320 | 8/2009 |
| WO | 2012/021171 | 2/2012 |

OTHER PUBLICATIONS

English Abstract of DE102004056220.
English Abstract of JP2009-172320.

*Primary Examiner* — Joshua Lee
(74) *Attorney, Agent, or Firm* — Cameron IP

(57) ABSTRACT

There is accordingly provided a flexible sheet assembly for stretching exercises. The assembly has a longitudinal axis. The assembly includes an elongate flexible sheet having a pair of spaced-apart longitudinally extending sides. The sheet has a pair of spaced-apart ends that extend between the sides. The sheet has a first longitudinal portion extending from a first one of the ends towards a second one of the ends. The sheet has a second longitudinal portion extending from the second one of the ends towards the first one of the ends. At least a first one of the longitudinal portions of the sheet has an aperture extending therethrough. Portions of the first one of the longitudinal portions of the sheet adjacent to the aperture are curved.

19 Claims, 12 Drawing Sheets

(51) Int. Cl.

| | |
|---|---|
| ***A63B 21/00*** | (2006.01) |
| ***A63B 21/055*** | (2006.01) |
| ***A63B 23/02*** | (2006.01) |
| ***A63B 23/035*** | (2006.01) |
| ***A63B 23/04*** | (2006.01) |
| ***A63B 23/12*** | (2006.01) |
| ***A61H 1/02*** | (2006.01) |
| *A63B 23/00* | (2006.01) |

(52) U.S. Cl.

CPC .... *A63B 21/0004* (2013.01); *A63B 21/00185* (2013.01); *A63B 21/0552* (2013.01); *A63B 21/4001* (2015.10); *A63B 21/4005* (2015.10); *A63B 21/4007* (2015.10); *A63B 21/4013* (2015.10); *A63B 21/4015* (2015.10); *A63B 21/4019* (2015.10); *A63B 21/4023* (2015.10); *A63B 21/4034* (2015.10); *A63B 21/4035* (2015.10); *A63B 21/4043* (2015.10); *A63B 23/0205* (2013.01); *A63B 23/0355* (2013.01); *A63B 23/03541* (2013.01); *A63B 23/03575* (2013.01); *A63B 23/04* (2013.01); *A63B 23/12* (2013.01); *A61H 2201/1261* (2013.01); *A61H 2201/164* (2013.01); *A61H 2201/1635* (2013.01); *A63B 21/4037* (2015.10); *A63B 23/0494* (2013.01); *A63B 2023/006* (2013.01); *A63B 2208/0209* (2013.01); *A63B 2208/0228* (2013.01); *A63B 2208/0247* (2013.01); *A63B 2208/0252* (2013.01)

(58) Field of Classification Search

CPC ..... A63B 21/0428; A63B 21/0442; A63B 21/055; A63B 21/0552; A63B 21/0555; A63B 21/0557; A63B 21/40; A63B 21/4001; A63B 21/4003; A63B 21/4005; A63B 21/4007; A63B 21/4009; A63B 21/4011; A63B 21/4013; A63B 21/4015; A63B 21/4017; A63B 21/4019; A63B 21/4021; A63B 21/4023; A63B 21/4025; A63B 21/4027; A63B 21/4033; A63B 21/4034; A63B 21/4043; A63B 2023/006

USPC ... 482/44, 47–49, 79, 91–92, 121–122, 124, 482/125–131, 133–135, 138–139, 148, 482/906–907, 910

See application file for complete search history.

(56) References Cited

U.S. PATENT DOCUMENTS

| | | | | |
|---|---|---|---|---|
| 5,518,486 | A | 5/1996 | Sheeler | |
| 5,588,941 | A | 12/1996 | Scott | |
| 5,647,823 | A | 7/1997 | Spence | |
| 5,674,163 | A | 10/1997 | Sennett | |
| 6,036,625 | A | 3/2000 | Woodruff | |
| 6,071,218 | A | 6/2000 | Tepperberg | |
| 6,110,075 | A * | 8/2000 | Woodruff | A63B 23/16 482/124 |
| 6,241,644 | B1 | 6/2001 | Tepperberg | |
| 6,338,700 | B1 | 1/2002 | Pollock | |
| 6,368,258 | B1 | 4/2002 | Emlaw | |
| 6,849,055 | B1 * | 2/2005 | Williams | A47K 7/022 15/208 |
| 7,044,896 | B2 | 5/2006 | Hetrick | |
| 7,309,305 | B2 | 12/2007 | Nichols | |
| 7,455,632 | B2 | 11/2008 | Block et al. | |
| D664,611 | S | 7/2012 | Pinskiy et al. | |
| 8,454,484 | B2 | 6/2013 | Keen et al. | |
| 8,696,521 | B2 | 4/2014 | Wu | |
| 2004/0064078 | A1 | 4/2004 | Winters | |
| 2005/0233879 | A1 * | 10/2005 | Harrington | A63B 23/035 482/148 |
| 2005/0271857 | A1 * | 12/2005 | Brody | A63B 21/0004 428/78 |
| 2007/0066467 | A1 * | 3/2007 | Edwards | A63B 6/00 482/148 |
| 2007/0265145 | A1 | 11/2007 | Teng | |
| 2008/0081746 | A1 * | 4/2008 | Woodruff | A63B 21/0004 482/121 |
| 2011/0224055 | A1 | 9/2011 | Kassel | |
| 2011/0281699 | A1 * | 11/2011 | Torres | A63B 21/00043 482/131 |
| 2012/0204900 | A1 * | 8/2012 | Mckenzie | A47K 10/02 134/6 |
| 2012/0295777 | A1 | 11/2012 | Zaki | |
| 2013/0303343 | A1 * | 11/2013 | Tritton | A63B 21/0442 482/122 |
| 2014/0179499 | A1 | 6/2014 | Weber et al. | |
| 2014/0215687 | A1 * | 8/2014 | Andrews | A41D 23/00 2/170 |
| 2015/0238055 | A1 * | 8/2015 | Manno | A47K 10/02 34/95.2 |
| 2015/0272400 | A1 * | 10/2015 | Lan | A47K 10/02 15/209.1 |

* cited by examiner

TOWEL STRETCHING ASSEMBLY FOR STRETCHING EXERCISES

FIELD OF THE INVENTION

There is provided a stretching assembly for stretching exercises. In particular, there is provided a towel stretching assembly for use in stretching exercises.

DESCRIPTION OF THE RELATED ART

Japanese Patent Reference No. 2009172320 to Oishi Misuzu provides a multipurpose towel. The towel includes a towel body 1 which has large holes 3 allowing both hands or both legs to be inserted therein and be engaged with the holes. Small holes 4 are formed in parallel to the large holes for windingly inserting the towels inside the holes and being engaged. The towel has elasticity for allowing a user to perform a reciprocating exercise for recovering the function of paralyzed hands and legs. The towel may be used as an exercise towel, a hand towel, a hair band, earflaps, a muffler or a bath towel.

The above towel may be limited in the scope of exercises that the user may perform. The towel may also be limited to certain body types absent continual adjustments of the towel. There accordingly may be a need for an improved towel stretching apparatus.

BRIEF SUMMARY OF INVENTION

There is provided a towel stretching apparatus for use in stretching exercises disclosed herein that overcomes the above disadvantages.

There is accordingly provided a flexible sheet assembly for stretching exercises. The assembly has a longitudinal axis. The assembly includes an elongate flexible sheet having a pair of spaced-apart longitudinally extending sides. The sheet has a pair of spaced-apart ends that extend between said sides. The sheet has a first longitudinal portion extending from a first one of the ends towards a second one of the ends. The sheet has a second longitudinal portion extending from the second one of the ends towards the first one of the ends. At least a first one of the longitudinal portions of the sheet has an aperture extending therethrough. Portions of the first one of the longitudinal portions of the sheet adjacent to the aperture are curved.

According to a further aspect, there is provided an elongate sheet assembly for stretching exercises. The assembly has a longitudinal axis. The assembly includes an elongate flexible sheet having a pair of spaced-apart longitudinally extending sides. The sheet has a pair of spaced-apart ends that extend between the sides. The sheet has a first longitudinal portion extending from a first one of the ends towards a second one of the ends. The sheet has a second longitudinal portion extending from the second one of the ends towards the first one of the ends. Each of the longitudinal portions has a plurality of longitudinally spaced-apart apertures extending therethrough. Respective portions of the sheet adjacent to the respective ones of the aperture are curved.

According to another aspect, there is provided a method of stretching one's limbs using an elongate stretching towel. The towel has an aperture extending through a first portion thereof. The towel has a second portion spaced-apart from the first portion and having a longitudinal axis. The method includes positioning the limb at least partially through the aperture of the towel. The method includes stretching the limb in a desired manner by exerting a pulling force on the second portion of the towel in the direction of the longitudinal axis thereof.

BRIEF DESCRIPTION OF DRAWINGS

The invention will be more readily understood from the following description of preferred embodiments thereof given, by way of example only, with reference to the accompanying drawings, in which.

DESCRIPTION OF THE PREFERRED EMBODIMENTS

Figure 1:
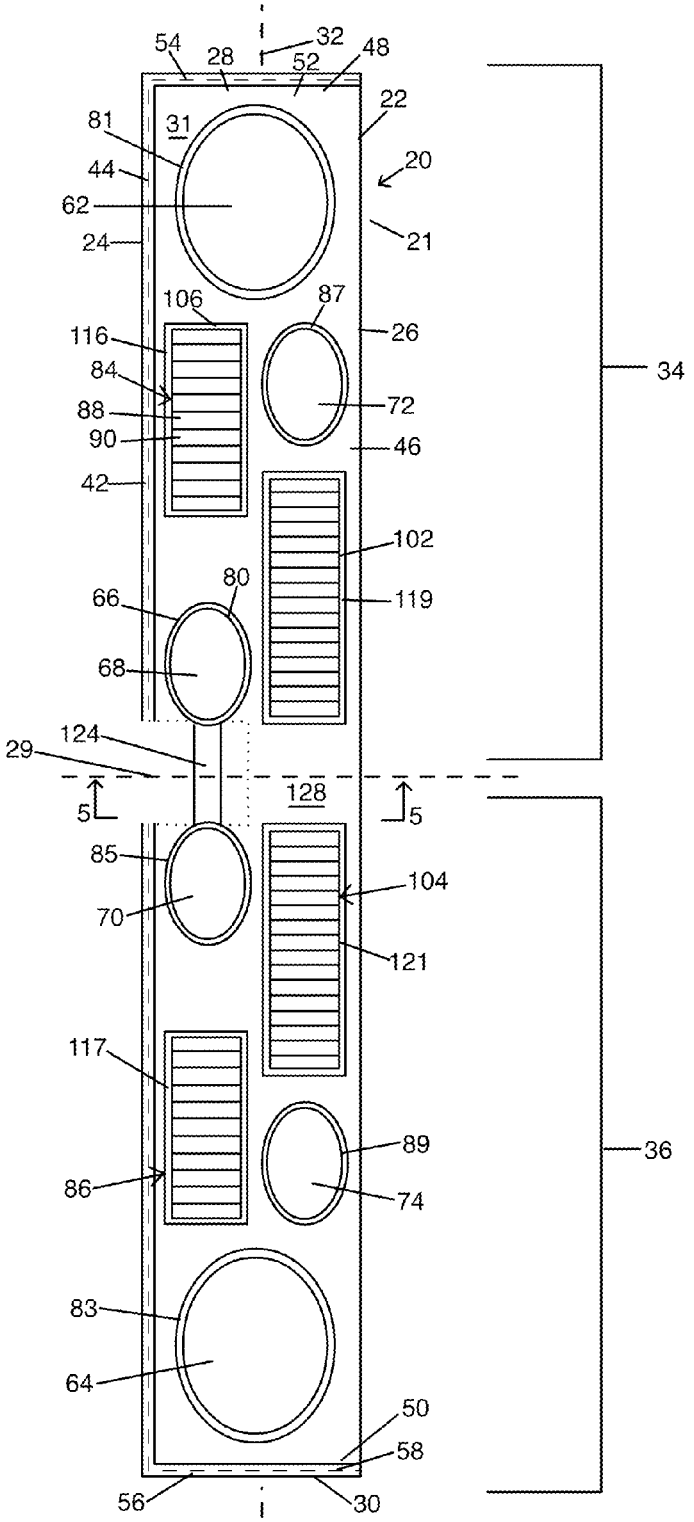
FIG. 1 is a top plan view of an elongate towel stretching assembly for use in stretching exercises, the assembly being partially in fragment, the bottom plan view of the assembly being a mirror image thereof.

Referring to the drawings and first to FIG. 1, there is shown an elongate sheet stretching assembly, in this example an elongate towel stretching assembly 20, for stretching exercises. Referring to FIG. 1, the assembly 20 comprises an elongate flexible sheet, in this example cloth, in this case a towel 22, though this is not strictly required. The assembly 20 has a generally rectangular body 21. The body has a pair of spaced-apart longitudinally extending sides 24 and 26. The assembly 20 includes a pair of spaced-apart ends 28 and 30 that extend between its sides. The assembly 20 includes a top 31 and bottom 32, seen in FIG. 5, which extend between sides 24 and 26 and ends 28 and 30. The top and bottom of the assembly are rectangular in this example. The assembly 20 has a longitudinal axis 33 which is interposed between and aligned in parallel with its sides 24 and 26. The axis extends through ends 28 and 30 of the assembly.

The assembly 20 includes a first longitudinal portion 34 which extends from end 28 to center 29 of the assembly. The body includes a second longitudinal portion 36 extending from end 30 to center 29 of the body. The longitudinal portions are rectangular in profile, extend between sides 24 and 26, and are a mirror image of each other in this example.

Figure 2:
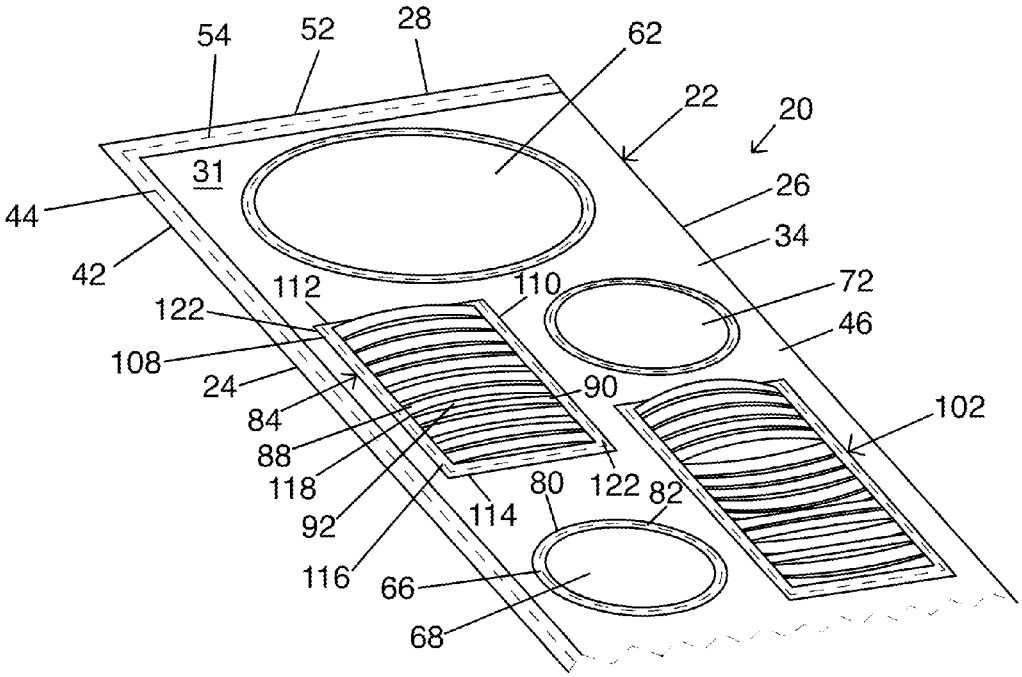
FIG. 2 is a perspective view of the towel assembly of FIG. 1 shown in fragment.
Figure 3:
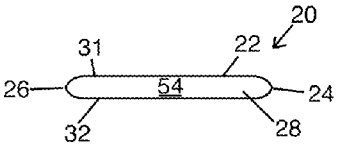
FIG. 3 is an end view of the towel assembly of FIG. 1, with the opposite end view being a mirror image thereof.
Figure 4:
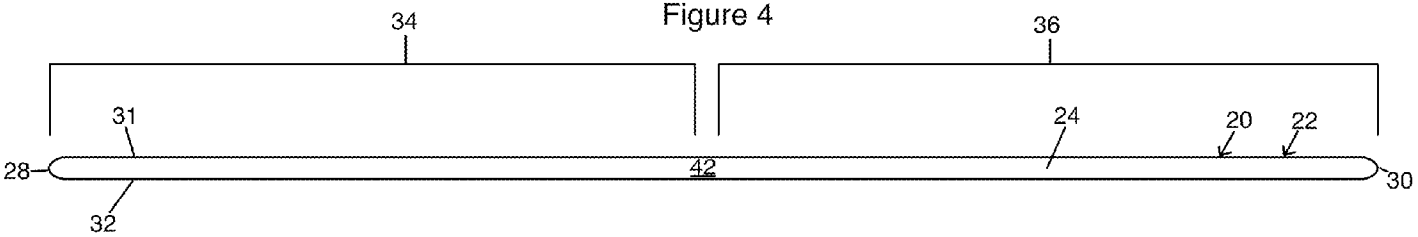
FIG. 4 is a left side elevation view of the towel assembly of FIG. 1, with the right side elevation view being a mirror image thereof.
Figure 5:
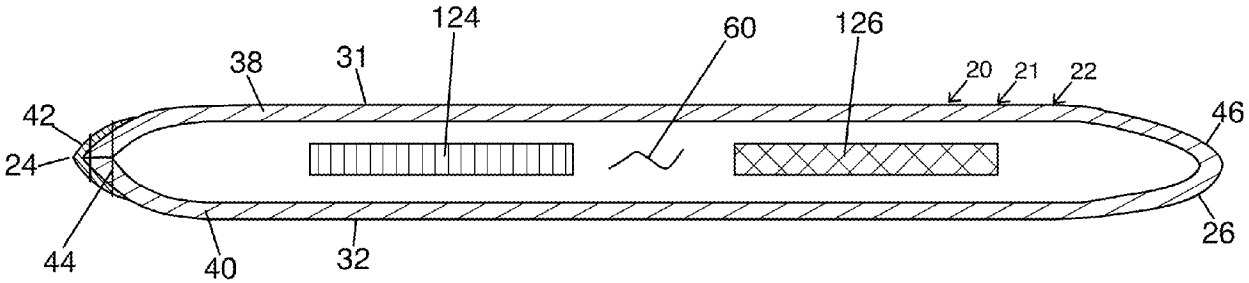
FIG. 5 is a sectional view taken along lines 5-5 of FIG. 1, the assembly being shown whole and not in fragment.

The towel 22 is longitudinally folded in two plies or layers in this example, with longitudinal peripheral portions 38 and 40 of the towel, seen in FIG. 5, connected together. As seen in FIG. 2, the layers are connected together in this example by a longitudinal reinforcement strip 42 and stitching 44 in this example. Reinforcement strip 42 is rectangular in shape in this example and folds around the peripheral portions 38 and 40 of the towel in this example. Stitching 44 extends through the reinforcement strip and portions 38 and 40. Reinforcement strip 42 aligns with and extends along side 24 of the assembly 20. Fold 46 of the towel is spaced-apart from peripheral portions 38 and 40 thereof and aligns with and extends along side 26 of the assembly. Ends 28 and 30 may be referred to as ends of the towel 22, sides 42 and 44 may be referred to as sides of the towel and longitudinal portions 34 and 36 may be referred to as longitudinal portions of the towel.

As seen in FIG. 1, the towel 22 has lateral peripheral portions 48 and 50 extending between the longitudinal peripheral portions 38 and 40 thereof. Lateral peripheral portion 38 of the towel is folded, with each of its folded halves being connected together via a first lateral reinforcement strip 52 and stitching 54 in this example. Reinforcement strip 52 is rectangular in this example and folds around the folded together lateral peripheral portion 38. The stitching 54 extends through the reinforcement strip and portion 38. Reinforcement strip 52 aligns with and is located along end 28 of the assembly 20. The folds of lateral peripheral portion 40 of the towel are connected together via a second lateral reinforcement strip 56 and stitching 58 in this example. Reinforcement strip 56 is rectangular in this example and folds around the folded together lateral peripheral portion 40. The stitching extends through the reinforcement strip 56 and portion 40. Reinforcement strip 56 aligns with and is located along end 30 of the assembly 20.

As seen in FIG. 5, the assembly 20 has an interior 60 around which towel 22 extends. The interior is interposed between top 31 and bottom 32 of body 21.

Referring back to FIG. 1, each of the longitudinal portions 34 and 36 of the assembly 20 has a plurality of longitudinally spaced-apart apertures extending therethrough. These include a first pair of outer apertures 62 and 64 extending through portions 34 and 36, respectively, of the assembly. The apertures are adjacent to ends 28 and 30, respectively, of the towel 22 and extend between sides 24 and 26 of the towel. The apertures align with the longitudinal axis 33 of the assembly.

There is also a second pair of inner apertures 68 and 70 extending through longitudinal portions 34 and 36, respectively, of the assembly. Apertures 68 and 70 are adjacent to each other and adjacent to side 24 of the towel 22 in this example. The inner apertures are offset to the left, from the perspective of FIG. 1, relative to the longitudinal axis 33 of the assembly 20.

The longitudinally spaced-apart apertures of the assembly 20 include a third pair of intermediate apertures 72 and 74 extending through longitudinal portions 34 and 36, respectively, of the assembly 20. Apertures 72 and 74 are adjacent to side 26 of the towel 22. The apertures are offset to the right, from the perspective of FIG. 1, relative to the longitudinal axis 33 of the assembly 20. Apertures 72 and 74 are positioned adjacent to apertures 62 and 64, respectively, and are spaced-apart from apertures 68 and 70, respectfully, in this example.

Figure 7:
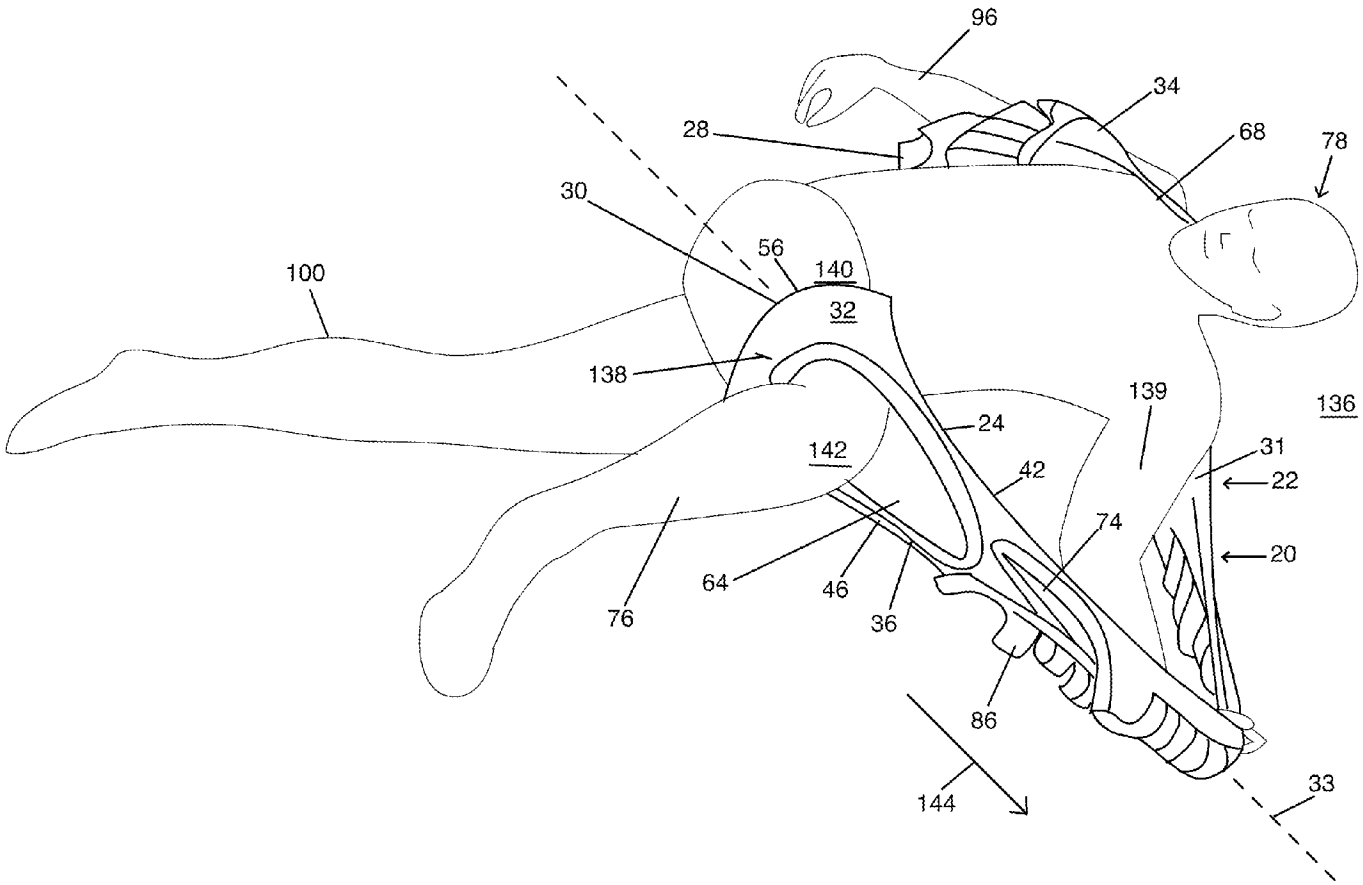
FIG. 7 is a top, side perspective view of the elongate assembly of FIG. 1 together with the user of FIG. 6, with the user causing portions adjacent to the aperture of the assembly to extend around his thigh of his right leg, bending his knee of the right leg, and pulling on the rest of the assembly to cause his right leg to move to his left, stretching the gluteus muscles associated with his right leg thereby, with the user extending the assembly around his neck and causing his left shoulder to extend through another aperture of the assembly.

Each of the apertures 62, 64, 68, 70, 72 and 74 is oval-shaped in this example. Portions of the towel 22 adjacent to the respective apertures are curved, as shown by portions 66 thereof adjacent to aperture 68 in FIG. 2. Each of the apertures 62, 64, 68, 70, 72 and 74 is shaped to receive a limb of a user. This is shown in FIG. 7 by right leg 76 of user 78 extending through aperture 64 of the assembly 20. Apertures 68, 70, 72, and 74 are substantially the same size in shape in this example and is shaped to accommodate a smaller user, such as a woman or child, and/or a small limb of a user. Apertures 62 and 64 are larger in diameter relative to apertures 68, 70, 72, and 74 and are shaped to accommodate the limbs of a larger user, such as an adult male.

The assembly 20 includes a plurality of peripheral annular members, in this example peripheral annular reinforcement strips that extend around the curved portions of the towel adjacent to respective ones of the apertures. This is shown in FIG. 2 by reinforcement strip 80, which is rectangular in shape in this example and which extends about aperture 68. Stitching 82 extends through the reinforcement strip and the curved edge 66 of the towel. Reinforcement strips 81, 83, 85, 87 and 89 extend around apertures 62, 64, 70, 72, and 74, respectively.

Referring back to FIG. 1, each of the longitudinal portions 34 and 36 of the assembly 20 has a plurality of longitudinally spaced-apart gripping assemblies. These include a first pair of outer gripping assemblies 84 and 86 for portions 34 and 36, respectively, of the assembly. As seen in FIG. 1, gripping assemblies 84 and 86 are adjacent to side 24 in this example and are offset to the left, from the perspective of FIG. 1, relative to the longitudinal axis 33 of the assembly 20. Gripping assembly 84 is adjacent to apertures 62 and 72 and interposed between apertures 62 and 68. Gripping assembly 86 is adjacent to apertures 64 and 70 and interposed between apertures 64 and 70.

The gripping assemblies also include a second pair of inner gripping assemblies 102 and 104 for longitudinal portions 34 and 36, respectively, of the assembly 20. As seen in FIG. 1, gripping assemblies 102 and 104 are adjacent to side 26 of the assembly in this example. The gripping assemblies are offset to the right, from the perspective of FIG. 1, relative to the longitudinal axis 33 of the assembly 20. Gripping assembly 102 is adjacent to apertures 68 and 72. Gripping assembly 104 is adjacent to apertures 70 and 74. Gripping assembly 102 and 104 are also adjacent to each other.

Figure 6:
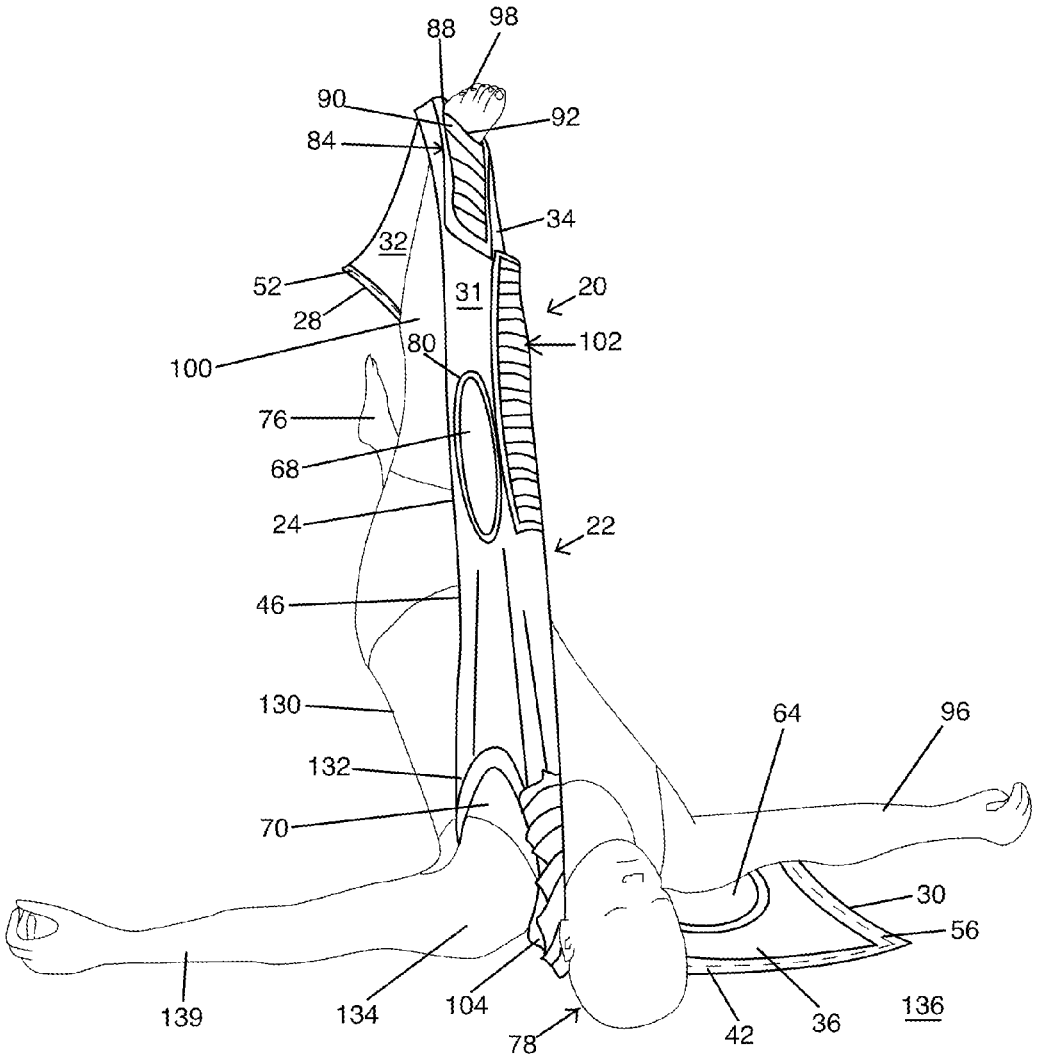
FIG. 6 is a top perspective view of the towel assembly of FIG. 1, together with a user therefor, the assembly having laterally-extending strips and an aperture, the user extending his feet through laterally-extending strips of the assembly and extending his shoulder through the aperture of the assembly to stretch his leg including his hamstrings.

Each of the above referred to griping assemblies, in this example, is in the form of longitudinally extend lateral strips with slits interposed between the lateral strips. This is seen in FIG. 2 by lateral strips 88 and 90, with slit 92 extending therebetween, for gripping assembly 84. Adjacent ones of the lateral strips 88 and 90 are configured to engage with part of a limb of the user, for example hands 94 of right arm 96 of the user 78 in FIG. 14, for example. Alternatively, this may be in the form of feet 98 of left leg 100 of the user 78 extending through slit 92, for example, as seen in FIG. 6.

The assembly 20 includes a plurality of apertures that are rectangular in shape in this example, for each of the gripping assemblies 84, 86, 102 and 104, as shown by aperture 106 for gripping assembly 84. Referring to FIG. 2, the assembly has a pair of spaced-apart longitudinal edge portions adjacent to the apertures of the gripping assemblies, as seen by portions 108 and 110 for aperture 106, and a pair of spaced-apart lateral edge portions adjacent to the apertures of the gripping assemblies, as seen by portions 112 and 114 for aperture 106. The lateral strips 88 and 90 extend between longitudinal edge portions 108 and 110.

The assembly 20 includes a plurality of peripheral rectangular members, in this example peripheral rectangular reinforcement strips that extend around the peripheral edge portions adjacent to respective ones of the apertures associated with the gripping assemblies 84, 86, 102 and 104. This is shown in FIG. 2 by reinforcement strip 116, which is rectangular in shape in this example and which folds around the portions 108, 110, 112 and 114 of the towel 22 adjacent to aperture 106. As seen in FIG. 2, each of the reinforcement strips 116 also extends overtop of the outer ends 118 and 120 of its respective lateral strips 88 and 90. Stitching 122 extends through the respective ones of reinforcement strips 116, ends 118 and 120 of the lateral strips, and portions 108, 110, 112 and 114 of the towel 22. As seen in FIG. 1, reinforcement strips 117, 119, and 121 extend around gripping assemblies 86, 102 and 104, respectively.

Reinforcement strips 42, 52, 56, 80, 81, 83, 85, 87, 89, 116, 117, 119 and 121, as well as lateral strips 88 and 90, are made of a material that is stronger that the towel 22 in this example. The strips are made of 60-40 blend of polyester and cotton, though this is not strictly required and other materials may be used.

As seen in FIGS. 1 and 5, the assembly 20 includes a pair of resilient members, in this example in the form of elastic-fabric bands 124 and 126 that are coupled to and extend between adjacent portions of the longitudinal portions 34 and 36 of the assembly 20. The bands are positioned within the interior 60 of the assembly 20 seen in FIG. 5. In this example, the band 124 couples to via stitching and extends between reinforcement strips 80 and 85 of apertures 68 and 70, respectively. Band 126 in this example couples to via stitching and extends between reinforcement strips 119 and 121 of gripping assemblies 102 and 104, respectively. Portions 128 of the towel adjacent to the bands may be at least partially folded when the bands are in their retracted positions. The bands 124 and 126 enable one of the longitudinal portions 34 and 36 of the assembly 20 to be pulled outwards relative to the other of the longitudinal portions, in this example by an amount of a few inches, though this amount is not strictly required.

In operation, FIG. 6 shows use of the assembly 20 as a part of a method of stretching one's limbs according to a first aspect. In the use shown in FIG. 6, the user 78 may lie on his back 130 and position left arm 96 through aperture 70 so as to cause portions 132 of the towel 22 adjacent to aperture 70 to extend around his shoulder 134. The rest of longitudinal portion 36 may then be interposed between the user's back 130 and the ground 136. The user may next raise his left leg 100, place his corresponding foot 98 through a slit 92 of adjacent lateral straps 88 and 90 of one of the gripping assemblies 84 and 102 and straighten the leg outwards and upwards. This may function to displace longitudinal portion 34 of the towel outwards to stretch relative to longitudinal portion 36 via bands 124 and 126 seen in FIG. 5. The user 78 may progressively position his foot between lateral straps that are closer to his body as desired to selectively deepen the stretching of his leg. The assembly 20 used in this manner may facilitate selectively stretching of one's hamstrings, for example.

Figure 8:
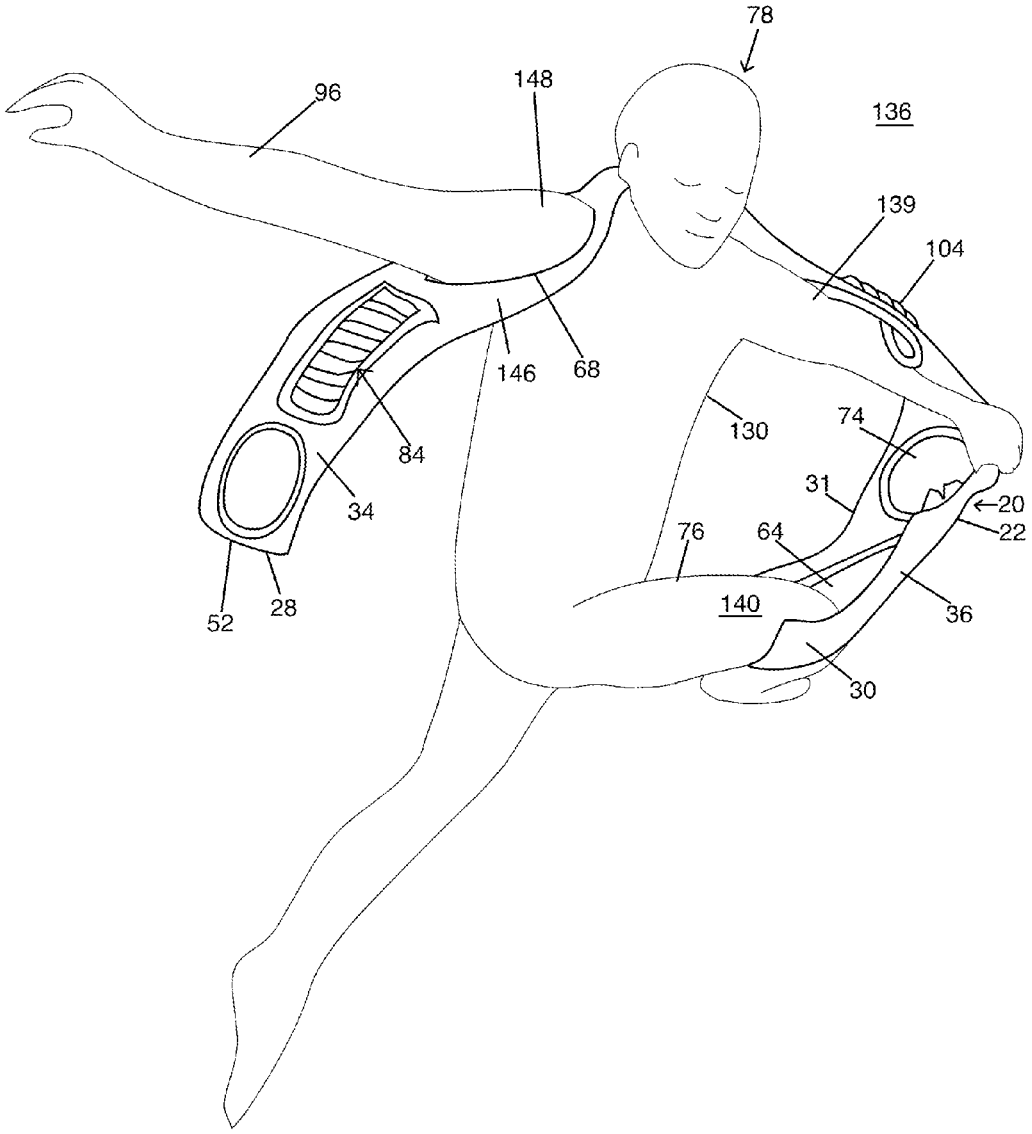
FIG. 8 is a top perspective view of the assembly and user of FIG. 7.

FIGS. 7 and 8 show the assembly 20 being used by user 78 according to a second aspect. The user lies on his back 130 and in this case extends his right leg 76 through aperture 64 so as to cause portions 138 adjacent to the aperture to extend around his thigh 140 adjacent to knee 142 in this example. Leg 76 is next stretched in a desired manner by exerting a pulling force, as shown by arrow 144 in FIG. 7, via his left arm 139 on the rest of the towel in the direction of the longitudinal axis 33 thereof. The user may next lie on top of longitudinal portion 34 of the assembly 20 once the limb is stretching in the desired manner. The user may further extend his right arm 96 through aperture 68 so that portions 146 adjacent thereto abut his right shoulder 148. In this manner, the user may selectively stretch his gluteus muscles, for example, in this case those associated with his right leg 76.

Figure 9:
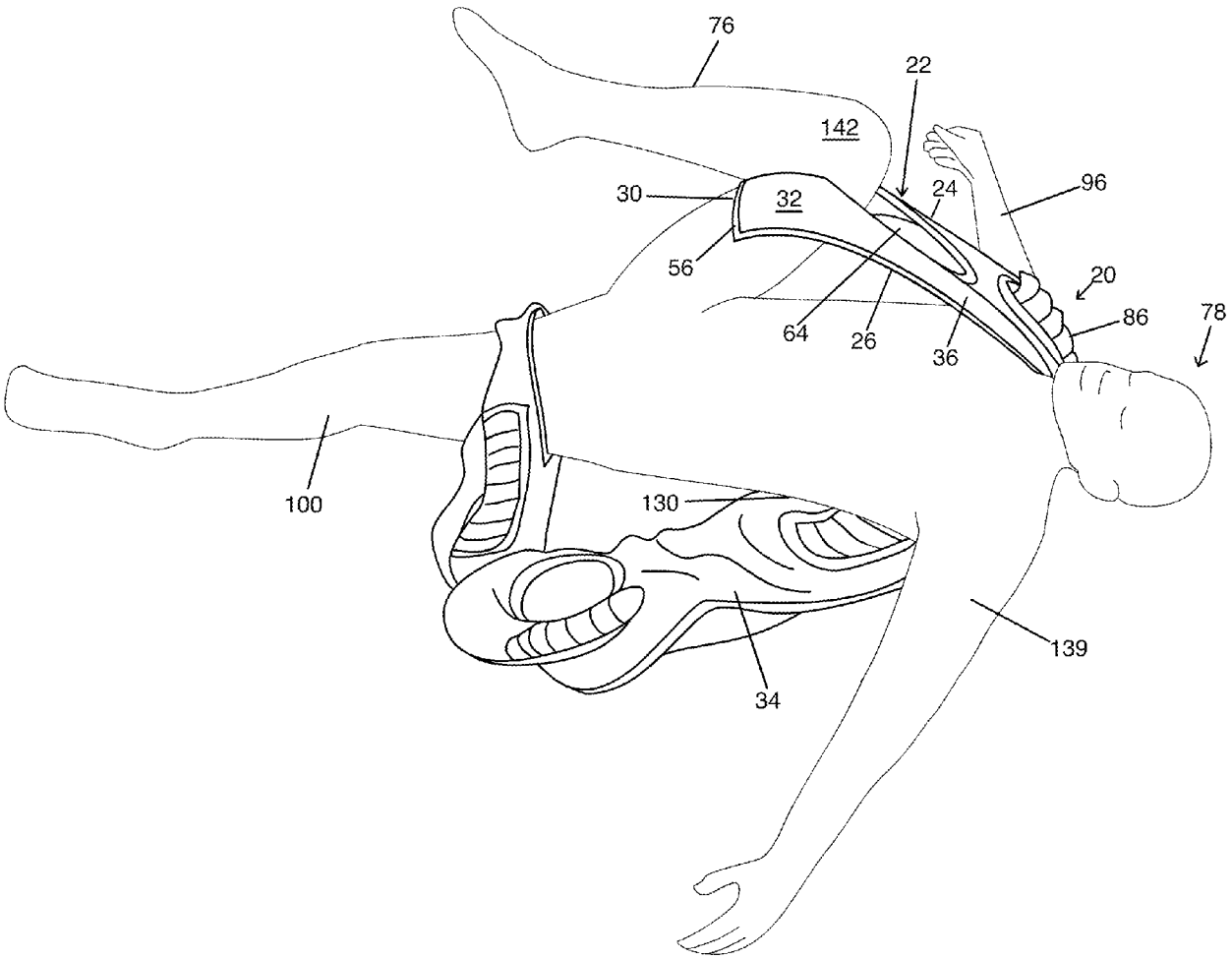
FIG. 9 is a top, side perspective view of the elongate assembly of FIG. 1 together with the user of FIG. 6, with the user causing portions adjacent to the aperture of the assembly to extend around his thigh of his right leg, the user bending his knee of the right leg, pulling a second portion of the assembly to elevate his right knee to move towards his chest, stretching associated gluteus and side muscles of his right leg thereby, folding the second portion of the assembly around his back, and lying down the second portion thereof to hold the right leg in the elevated stretched position.
Figure 10:
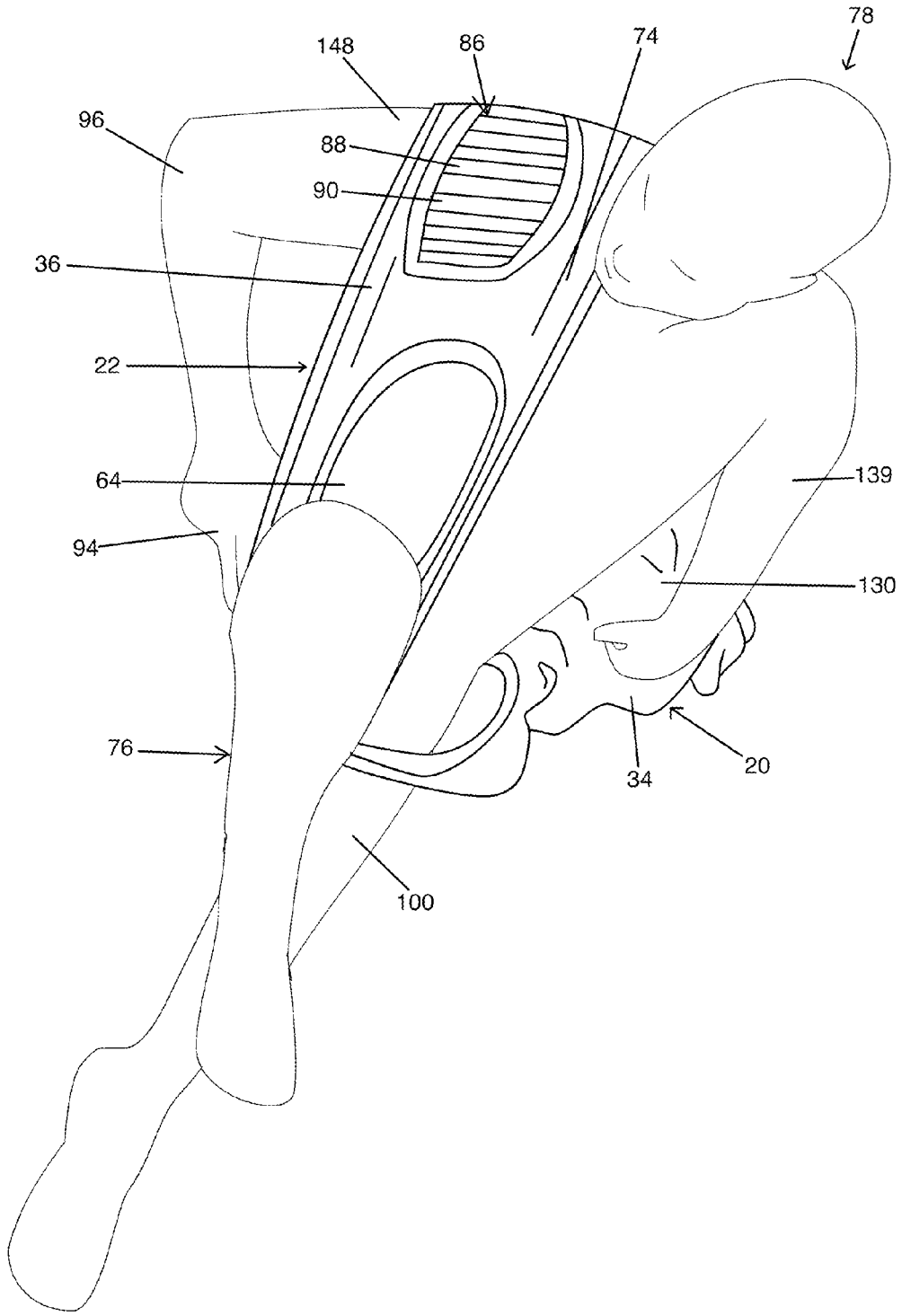
FIG. 10 is a top perspective view of the assembly and user of FIG. 9, with the user extending his left shoulder through an adjacent aperture of the assembly, the rest of the assembly folding around the user's back and being interposed between the user's back and the ground.

FIGS. 9 and 10 show use of the assembly 20 according to a third aspect. In this case, the user is in a position similar to that shown in FIGS. 7 and 8 with the exception that gripping assembly 86 of lateral straps may selectively engage with right shoulder 148. This may cause the user's knee 142 to lift towards the rest of his body further promote stretching of the gluteus muscles. The rest of the towel 22 may wrap around the user's back 130 and be further held in place thereby once the assembly 20 is in the desired position. The user may also selectively deepen the stretch by causing the shoulder 148 to engage lateral straps 88 and 90 which are more adjacent to aperture 64 and the user's knee 142.

Figure 11:
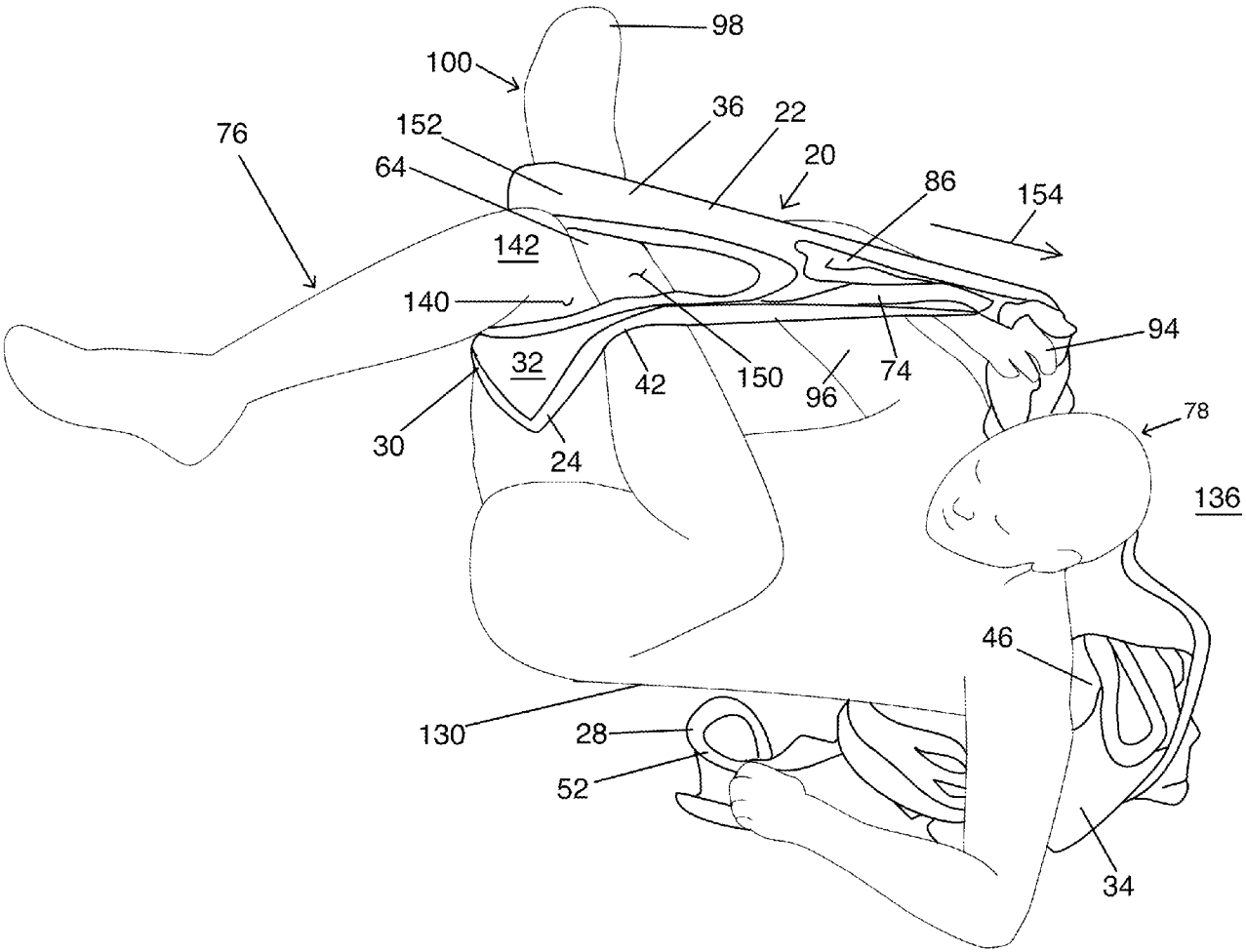
FIG. 11 is a top, side perspective view of the assembly and user of FIG. 9, with the user's left leg being bent and the lower shin of the user's left leg abutting the lower thigh of the user's right leg adjacent to the user's right knee while the user pulls his right knee towards his chest via the assembly, thereby facilitating further stretching of the user's left leg.
Figure 12:
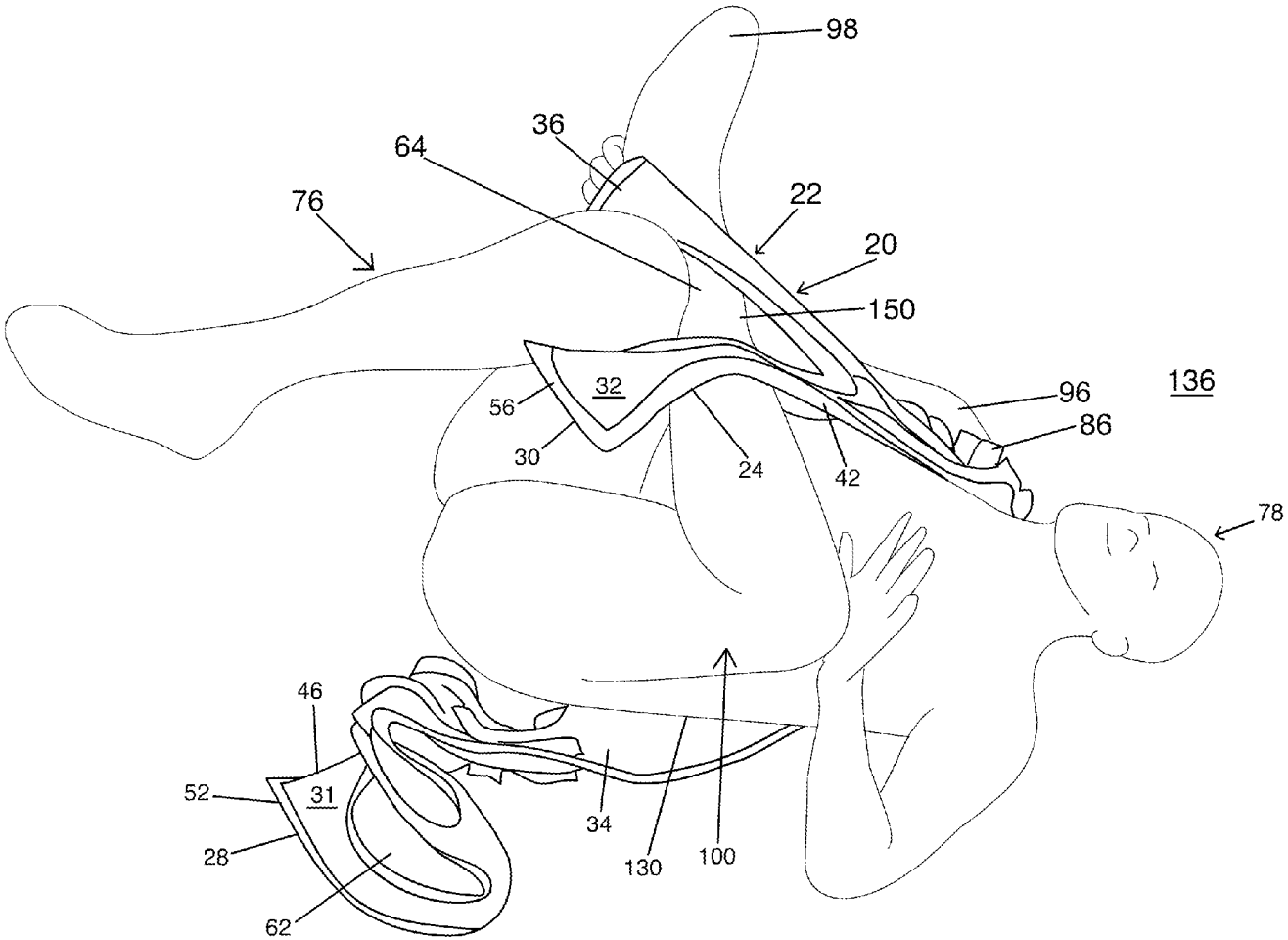
FIG. 12 is a top, side perspective view similar to FIG. 11 in which the user folds the rest of the assembly around his back and lies down on it to hold his legs in the stretched position of FIG. 11.

FIGS. 11 and 12 show use of the assembly 20 according to a fourth aspect.

In this case, the user is in a position similar to that shown in FIGS. 9 and 10 with the following exceptions. The lower part 150 of the user's left leg 100 abuts on top of the thigh 140 of the user's right leg 76. Portions 152 of the towel 22 adjacent to aperture 64 may at least partially wrap around and connect legs 76 and 100 together. The user may then grab the rest of the towel and pull in a direction parallel with the longitudinal axis of the towel, as seen by arrow 154 in FIG. 11. Alternatively, the user may cause straps 88 and 90 of gripping assembly 86 to engage with right shoulder 148, with the rest of the towel between interposed between the user's back and the ground.

Figure 13:
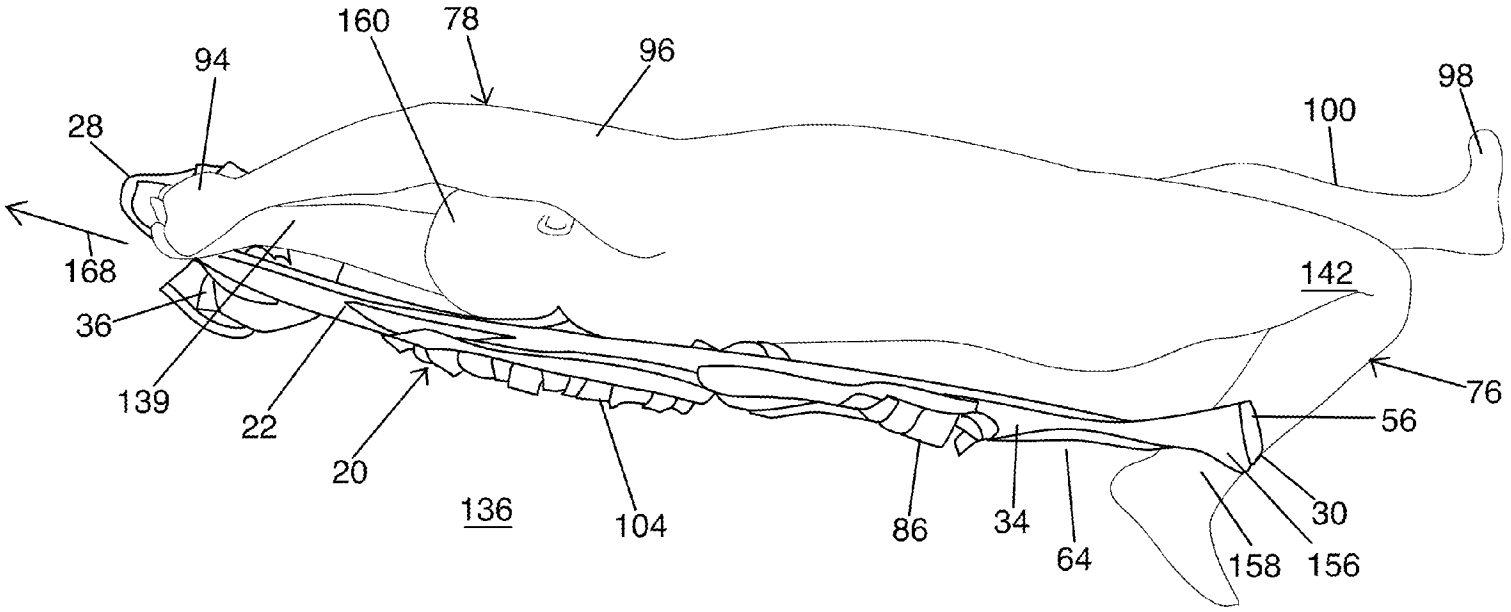
FIG. 13 is a top, side perspective view of the assembly of FIG. 1 and user of FIG. 6, with the user lying on his side, extending the foot of his left leg through one of the apertures of the assembly, pulling on the rest of the assembly in a direction of extending parallel with his body, causing his left leg to bend and stretching his left leg thereby including his quadriceps thereof.

FIG. 13 shows use of the assembly 20 according to a fifth aspect. In this case, the user lies on his side and extends his right leg through aperture 64, with adjacent portions 156 thereof engaging around the user's ankle 158. The user 78 then bends his knee 142, reaches behind his back 130 to grab the rest of the towel 22, and then extends his arms 96 and 139 outwards above his head 160. Such a use of the assembly 20 may enable the user 78 to selectively stretch respective ones of his quadriceps, for example.

Figure 14:
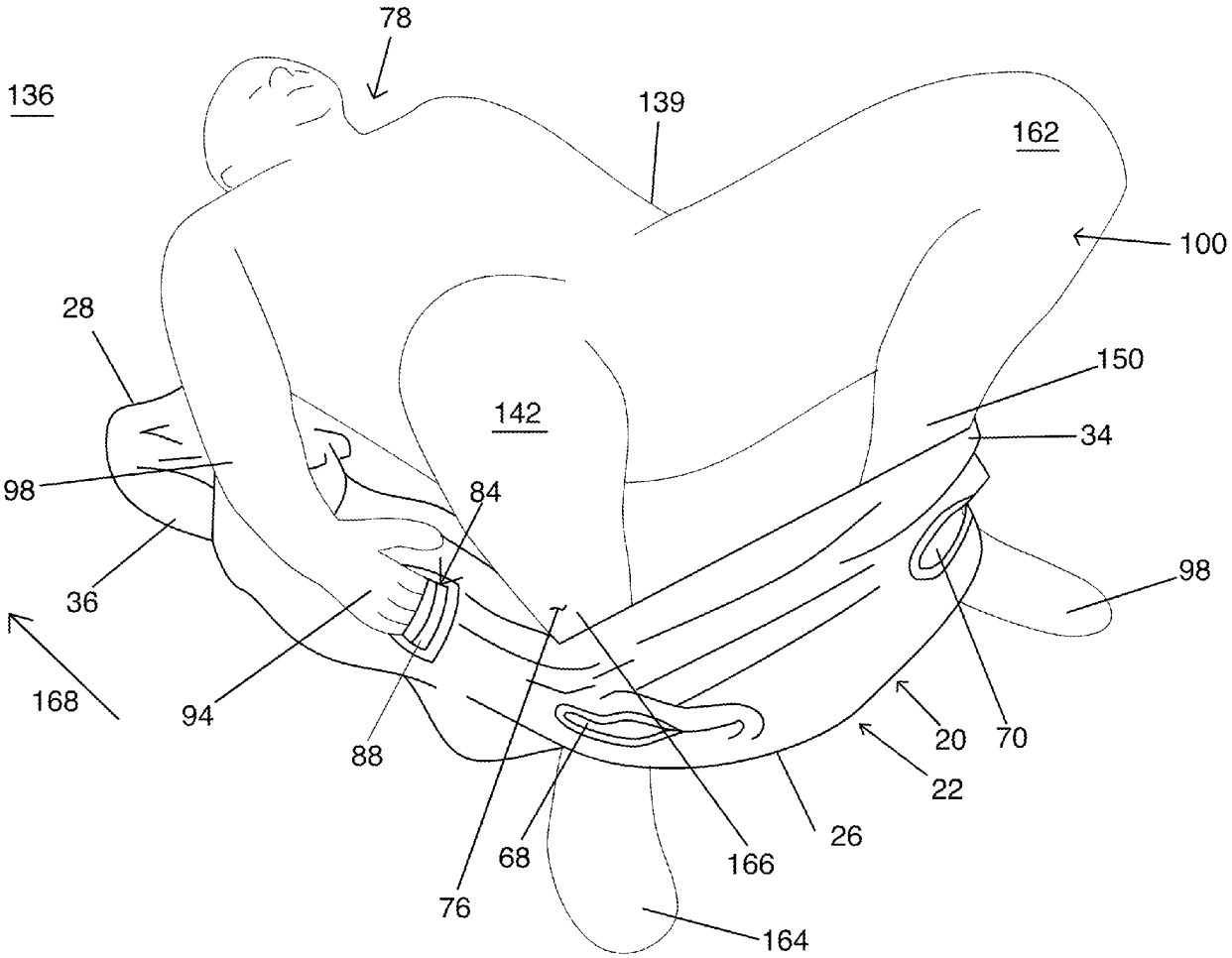
FIG. 14 is a top perspective view of the assembly of FIG. 1 and user of FIG. 6, with the user lying on his back, bending his knees, wrapping the assembly around his feet while keeping his feet on the ground, and pulling on outer portions of the assembly so as to bias his feet towards his body, thereby facilitating further stretching of the user's body via the assembly.

FIG. 14 shows use of the assembly 20 according to a sixth aspect. In this case, the user lies on his back, bends both of his knees 142 and 162, and places his feet 98 and 164 on the ground 136. The assembly 20 is next wrapped around the lower parts 150 and 166 of his legs 100 and 76. The user 78 then selectively pull on gripping assemblies 84 and 86 of lateral straps, seen in FIG. 1, via his arms 96 and 139 in the direction shown by arrow 168 so as to cause his feet to move towards the user's buttock 170. In this manner, the assembly 20 may be used to further stretch of the user's quadriceps and/or core muscles, for example.

It will be appreciated that many variations are possible within the scope of the invention described herein. For example, the towel may comprise fleece fabric or other materials in other examples.

Also, the examples discussed in FIGS. 6 to 14 may equally apply to the other of the user's limbs in a mirrored-manner. Where aperture 64 is referred to, one may alternatively use another longitudinally spaced-apart aperture, such as aperture 74, in situations where the user may be smaller, for example.

It will also be understood by someone skilled in the art that many of the details provided above are by way of example only and are not intended to limit the scope of the invention which is to be determined with reference to at least the following claims.

What is claimed is:

1. A flexible sheet assembly for stretching exercises, the assembly having a longitudinal axis and comprising:

an elongate flexible sheet having a pair of spaced-apart longitudinally extending sides, a pair of spaced-apart ends that extend between said sides, a first longitudinal portion extending from a first one of the ends towards a second one of the ends, a first aperture extending through said first longitudinal portion of the sheet, portions of said first longitudinal portion of the sheet adjacent to the first aperture being curved, a second longitudinal portion extending from the second one of the ends towards the first one of the ends of the sheet, and a second aperture extending through said second longitudinal portion of the sheet; and a plurality of laterally-extending strips connecting to the second longitudinal portion of the sheet, the strips extending across the second aperture of the sheet with a plurality of spaced-apart, laterally-extending slits between said strips, the slits extending through the second longitudinal portion of the sheet;

wherein a stretching exercise can be performed by exerting a pulling force on the second longitudinal portion in a direction of the longitudinal axis thereof.

2. The assembly as claimed in claim 1 wherein the first aperture is shaped to receive a first limb of a user and adjacent ones of the strips are configured to engage with a second limb of the user.

3. The assembly as claimed in claim 1 further comprising a reinforcement strip that extends around the first aperture, the reinforcement strip being stronger than said first longitudinal portion of the sheet.

4. The assembly as claimed in claim 1 further comprising a resilient member coupled to and extending between the first longitudinal portion of the sheet and the second longitudinal portion of the sheet.

5. The assembly as claimed in claim 4, wherein the assembly further comprises a pair of peripheral annular members, each of said annular members extending around a respective one of the apertures, the resilient member coupling to and extending between the annular members.

6. The assembly as claimed in claim 1 wherein the elongate sheet comprises a rectangular towel, the towel having longitudinal peripheral portions and lateral peripheral portions extending between the longitudinal peripheral portions, and the towel being longitudinally folded in two, with its longitudinal peripheral portions connected together and its lateral peripheral portions connected together.

7. The assembly as claimed in claim 1 wherein the elongate sheet comprises fleece fabric.

8. The assembly as claimed in claim 1 wherein the first aperture is oval-shaped.

9. The assembly as claimed in claim 1 wherein the second aperture is rectangular in shape.

10. The assembly as claimed in claim 1, the assembly having an interior and further comprising a pair of elastic-fabric bands coupled to and extending between the first longitudinal portion of the sheet and the second longitudinal portion of the sheet, the bands being positioned within the interior of the assembly, the bands enabling one of the longitudinal portions to be pulled outwards relative to the other of the longitudinal portions of the sheet.

11. An elongate sheet assembly for stretching exercises, the assembly having a longitudinal axis and comprising:

an elongate flexible sheet having a pair of spaced-apart longitudinally extending sides, a pair of spaced-apart ends that extend between said sides, a first longitudinal portion extending from a first one of the ends towards a second one of the ends, and a second longitudinal portion extending from the second one of the ends towards the first one of the ends, each of the longitudinal portions having a plurality of longitudinally spaced-apart apertures extending therethrough, respective portions of the sheet adjacent to said respective apertures being curved, and wherein outer ones of the apertures are adjacent to respective ones of the ends of the sheet, are interposed between the sides of the sheet, align with the longitudinal axis of the assembly and are larger in diameter relative to inner ones of the apertures; and a plurality of laterally-extending strips connecting to the second longitudinal portion of the sheet, the strips extending across one of the apertures of the second longitudinal portion with a plurality of spaced-apart, laterally-extending slits between said strips, the slits extending through the second longitudinal portion of the sheet;

wherein a stretching exercise can be performed by exerting a pulling force on the second longitudinal portion in a direction of the longitudinal axis thereof.

12. The assembly as claimed in claim 11 wherein said inner ones of the apertures extend through respective ones of the longitudinal portions of the sheet, and are adjacent to each other.

13. The assembly as claimed in claim 12 wherein said inner ones of the apertures are adjacent to a first one of the sides of the sheet and are offset from the longitudinal axis of the assembly and wherein intermediate ones of the apertures extend through respective ones of the longitudinal portions of the sheet, are adjacent to a second one of the sides of the sheet and are offset from the longitudinal axis of the assembly.

14. The assembly as claimed in claim 11 wherein, inner ones of the plurality of laterally-extending strips with slits interposed therebetween being adjacent to each other, being adjacent to a first one of the sides of the sheet and being axially offset from the longitudinal axis of the assembly, and outer ones of the plurality of laterally-extending strips with slits interposed therebetween being interposed between said inner and outer ones of the apertures of the respective ones of the longitudinal portions of the sheet, being adjacent to a second of the sides of the sheet and being axially offset from the longitudinal axis of the assembly.

15. The assembly as claimed in claim 11 wherein the apertures are oval-shaped.

16. A method of stretching one's limbs using an elongate stretching towel, the towel having an aperture extending through a first portion thereof, having a second portion spaced-apart from the first portion and having a longitudinal axis, the method comprising:

positioning a leg of a user at least partially through the aperture of the first portion of the towel and causing portions adjacent to the aperture of the first portion of the towel to extend around a thigh of said leg;

stretching said leg in a desired manner by exerting a pulling force on the second portion of the towel in a direction of the longitudinal axis thereof; and lying on top at least part of the second portion of the towel once said leg is stretching in the desired manner.

17. The method as claimed in claim 16, the towel having a plurality of laterally-extending strips extending across the aperture, and the method further comprising:

selectively deepening the stretching of said one of the limbs by selectively engaging with ones of the strips that are progressively closer to the second portion of the towel.

18. A method of stretching using an elongate stretching towel, the towel having an aperture extending through a first portion thereof, having a second portion spaced-apart from the first portion, having an aperture extending through the second portion thereof, and having a longitudinal axis, the method comprising:

positioning a leg of a user at least partially through the aperture of the first portion of the towel and causing portions adjacent to the aperture of the first portion of the towel to extend around a thigh of said leg;

stretching said leg in a desired manner by exerting a pulling force on the second portion of the towel in a direction of the longitudinal axis thereof; and causing portions adjacent to the aperture of the second portion of the towel to extend around the user's shoulder.

19. A method of stretching using an elongate stretching towel, the towel having an aperture extending through a first portion thereof, including a plurality of laterally-extending strips extending across the aperture of the first portion thereof, having a second portion spaced-apart from the first portion thereof, having an aperture extending through the second portion thereof, and having a longitudinal axis, the method comprising:

positioning a leg of a user at least partially through the aperture of the first portion of the towel by extending a foot of said leg through the aperture of the first portion of the towel and between adjacent ones of the strips;

causing portions adjacent to the aperture of the second portion of the towel to extend around the user's shoulder; and stretching said leg connected to the strips in a desired manner by straightening said leg outwards and thus exerting a pulling force on the second portion of the towel in a direction of the longitudinal axis thereof.

* * * * *